US005202703A

United States Patent [19]

Hoisington et al.

[11] Patent Number: 5,202,703

[45] Date of Patent: Apr. 13, 1993

[54] PIEZOELECTRIC TRANSDUCERS FOR INK JET SYSTEMS

[75] Inventors: Paul A. Hoisington, Norwich, Vt.; Bruce A. Paulson, Newport, N.H.

[73] Assignee: Spectra, Inc., Hanover, N.H.

[21] Appl. No.: 615,898

[22] Filed: Nov. 20, 1990

[51] Int. Cl.[5] ..... B41J 2/045

[52] U.S. Cl. ..... 346/140 R

[58] Field of Search ..... 346/140 R, 75; 310/330, 310/331, 333, 364, 365, 366

[56] References Cited

U.S. PATENT DOCUMENTS

| | | | |
|---|---|---|---|
| 4,459,601 | 7/1984 | Howkins | 346/140 R |
| 4,516,140 | 5/1985 | Durkee et al. | 346/140 R |
| 4,584,590 | 4/1986 | Fischbeck et al. | 346/140 R |
| 4,825,227 | 4/1989 | Fischbeck et al. | 346/1.1 |
| 4,879,568 | 11/1989 | Bartky et al. | 346/140 R |
| 4,901,092 | 2/1990 | Moriyama | 346/140 R |

*Primary Examiner*—Benjamin R. Fuller
*Assistant Examiner*—Alrick Bobb
*Attorney, Agent, or Firm*—Brumbaugh, Graves, Donohue & Raymond

[57] ABSTRACT

In the representative embodiments of the invention described herein, a transducer for an ink jet system includes a piezoelectric element with an array of spaced interdigitated electrodes on one side of the element. One embodiment includes two such arrays disposed near the sides of the ink jet chamber and another array of interdigitated electrodes on the opposite side of the transducer in the central region of the ink jet chamber. In that embodiment, continuous electrodes are provided on the surfaces of the transducer opposite to the surfaces bearing the interdigitated arrays. Alternate electrodes in each array and the continuous electrode on the opposite side are grounded and positive or negative potential is applied to the other electrodes in the arrays to produce deflection of the transducer element and alternate pulses of opposite polarity may be applied to polarize the piezoelectric element in opposite directions with each pulse. Using a transducer thickness of about 4 microns, ejection of a drop of given size with a given voltage pulse can be achieved with a chamber volume which is one-twentieth to one-fortieth the size of the chamber volume required for conventional transducer arrangements.

20 Claims, 1 Drawing Sheet

PIEZOELECTRIC TRANSDUCERS FOR INK JET SYSTEMS

BACKGROUND OF THE INVENTION

This invention relates to piezoelectric transducer arrangements for ink jet systems and, more particularly, to new and improved ink jet transducer arrangements providing improved performance.

Heretofore, electromechanical transducers such as piezoelectric elements designed to provide one movable wall of an ink chamber in an ink jet system have operated either in an extension mode, such as described in the Howkins U.S. Pat. No. 4,459,601, in which a piezoelectric transducer is expanded upon application of a voltage in a direction perpendicular to the wall of the ink chamber, or in a shear mode, as described in the Fischbeck et al. U.S. Pat. No. 4,584,590, in which the transducer forming a wall of an ink chamber is subjected to a field which causes a shear in the transducer member, forcing a portion of the member to move laterally with respect to the plane of the member. Both of those arrangements not only require a relatively high voltage to produce a desired degree of displacement of a transducer forming the wall of an ink jet chamber, but, in addition, they occupy a substantial volume, causing the ink jet heads in which they are used to be relatively large and heavy, thereby requiring significant driving energy in systems in which the ink jet head is reciprocated with respect to a substrate which receives the ejected ink. In addition, because of the relatively large transducer volume required for each ink jet, the spacing of the ink jets in an ink jet array is substantially larger than the desired spacing of the image lines to be produced during printing with the array.

SUMMARY OF THE INVENTION

Accordingly, it is an object of the present invention to provide a new and improved ink jet transducer arrangement which overcomes the above-mentioned disadvantages of the prior art.

Another object of the invention is to provide a new and improved ink jet system having substantially reduced weight and volume.

These and other objects of the invention are attained by providing a plate-shaped piezoelectric transducer element having a region provided with an array of spaced interdigitated electrodes on one surface to which two differing electrical potentials are applied in alternating sequence opposed by a single continuous electrode on the opposite surface to which one of the two potentials is applied so that, when the electrodes are energized, the piezoelectric effect causes the transducer to bend. Preferably, a transducer of this type arranged for use with an ink jet chamber includes an array of interdigitated electrodes on one surface in the central region and two further arrays of interdigitated electrodes on the other surface which are between the central region and the chamber walls. In each case, the surface portion opposite the interdigitated electrodes has a substantially continuous electrode so that, when the electrodes are energized as described above, the side portions have a curvature extending from the sides of the chamber away from the normal plane of the transducer and the central portion is displaced from the normal transducer plane and has a curvature with a radius extending toward that plane.

BRIEF DESCRIPTION OF THE DRAWINGS

Further objects and advantages of the invention will be apparent from a reading of the following description in conjunction with the accompanying drawings in which.

DESCRIPTION OF PREFERRED EMBODIMENTS

Figure 1:
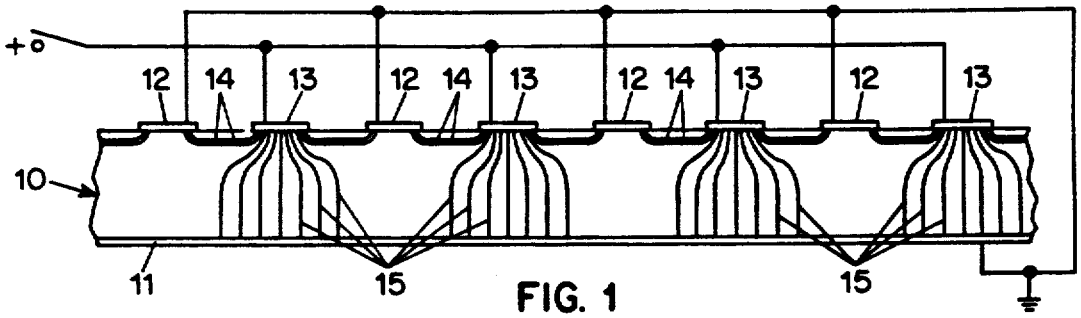
FIG. 1 is an enlarged schematic fragmentary view of a piezoelectric transducer segment arranged in accordance with one embodiment of the invention, illustrating the arrangement of electrodes on the transducer surface and the resulting field lines.

In the representative transducer arrangement shown in the fragmentary illustration of FIG. 1, a plate-shaped piezoelectric transducer segment 10 has a single continuous electrode 11 affixed to one surface and an electrode consisting of two interdigitated series of spaced electrodes 12 and 13 affixed to the opposite surface. When a selected potential is applied to the electrode 11 on one surface and the electrodes 12 on the other surface and a different potential is applied to the electrodes 13 on the other surface, an electric field is produced within the transducer having field lines 14 and 15 with a distribution of the type shown in FIG. 1. In the typical example illustrated in FIG. 1, the electrode 11 and the electrodes 12 are grounded and the electrodes 13 are arranged to be connected to a positive potential, but the electrodes 13 may be connected to negative potential or any other arrangement for providing a potential difference between the electrodes 11 and 12 on the one hand and the electrodes 13 on the other hand may be utilized.

With this arrangement, a field with lines 14 extending substantially parallel to the plane of the transducer plate 10 will be produced beneath the transducer surface between the adjacent pairs of electrodes 12 and 13, whereas a field with lines 15 which extend substantially perpendicular to the plane of the transducer will be produced in the transducer adjacent to the centers of the electrodes 13 on one surface and adjacent to the electrode 11 on the opposite surface.

The illustration of FIG. 1 shows the manner in which the transducer 10 of this embodiment is initially polarized as well as the field produced during operation of the ink jet system. Preferably, the potential difference applied to the electrodes for transducer actuation is in the same direction as the polarizing potential, thereby avoiding depolarization of the transducer during operation. While FIG. 1 illustrates the field lines resulting from application of different potentials to the interdigitated electrodes 12 and 13, the electromechanical effect of the application of the potential difference is not shown in FIG. 1.

Figure 2:
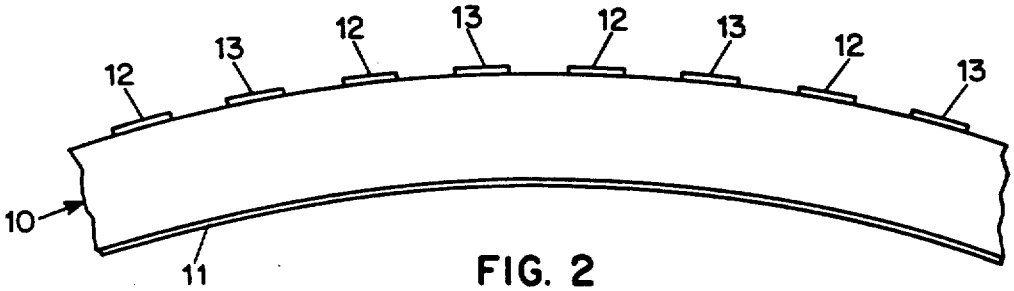
FIG. 2 is a schematic illustration of the transducer segment shown in FIG. 1 showing the curvature induced in the transducer in response to energization of the electrodes.

FIG. 2 shows the mechanical effect produced by the field illustrated in FIG. 1. Since the transducer plate tends to expand in the regions between the electrodes 12 and 13 where the field lines run substantially parallel to the plane of the plate and to contract in the region adjacent to the electrode 11 where the field lines extend substantially perpendicular to the plane of the plate, the transducer plate will be bent in the manner shown in FIG. 2. In this connection, it will be noted that, because the field lines adjacent to the central portions of the electrodes 13 extend in the direction generally perpendicular to the plane of the transducer, those portions tend to contract upon application of the electric field, which subtracts from the expansion of the region adjacent to that surface caused by the field extending parallel to the plane of the plate between the electrodes. Nevertheless, the net effect of the application of a potential difference to the interdigitated electrodes is to produce an expansion of the region adjacent to the surface having the interdigitated electrodes and a contraction of the opposite surface so as to produce the curvature shown in FIG. 2.

Alternatively, if desired, the potential applied to the electrode 11 may be intermediate between the potentials applied to the electrodes 12 and 13, or no potential may be applied to the electrode 11 and that electrode may be permitted to float. In such cases, the same bending effect described above is obtained, but the magnitude of the bending is not as large. For example, if the potential applied to the electrode 11 is halfway between the potentials applied to the electrodes 12 and 13, the bending effect is approximately 85% of that obtained in the manner described with respect to FIGS. 1 and 2.

Because the radius of curvature is proportional to the thickness of the piezoelectric transducer, a relatively thin piezoelectric element, less than 100 microns thick, is desirable. Preferably, the piezoelectric element is made by thin-film techniques such as are described, for example, in the copending Hoisington et al. application Ser. No. 07/615,893 filed Mar. 20, 1990 for "THIN-FILM TRANSDUCER INK JET HEAD", and has a thickness less than 25 microns, desirably less than 10 microns, and most desirably in the range from about 1-5 microns. Such thin transducer elements will produce maximum bending of the transducer in response to a given applied voltage. Although the electrode 11 shown in the drawings is continuous, it will be apparent that substantially the same effect can be produced if the continuous electrode is replaced by an array of closely-spaced electrodes which are maintained at the same potential.

Figure 3:
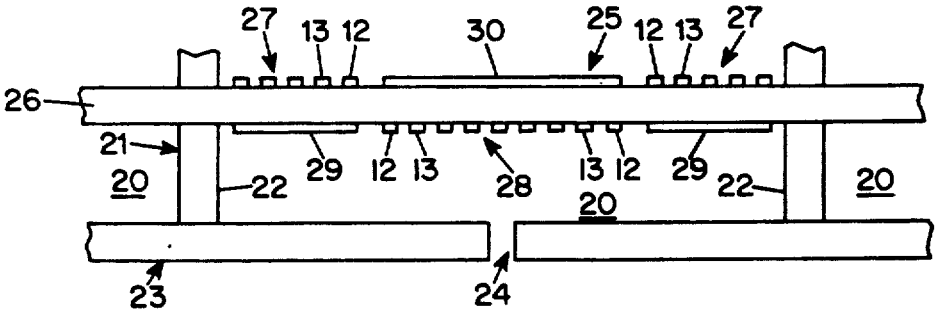
FIG. 3 is a schematic cross-sectional fragmentary view illustrating a portion of a representative ink jet system arranged in accordance with another embodiment of the invention showing an ink jet chamber with a transducer in the deenergized condition.

FIG. 3 illustrates schematically a portion of a typical ink jet system arranged in accordance with another embodiment of the invention. In this ink jet system, an array of adjacent ink jet chambers 20, with corresponding orifices and transducer segments, is provided, only one of which is shown in detail in the drawing. In the illustrated example, the ink jet chamber 20 is formed in a chamber plate 21, providing sidewalls 22 as well as end walls not shown in the drawing. The opening is covered on one side by an orifice plate 23 having a series of orifices 24, only one of which is illustrated, and the opposite wall is formed by a transducer arrangement 25. Thus, it will be understood that a series of adjacent identical ink jet chambers 20 are formed in the plate 21 and a corresponding spaced array of orifices 24 is provided in the plate 23 for selective ejection of ink by corresponding piezoelectric transducer arrangements 25.

In the illustrated embodiment, the transducer arrangement 25 includes a segment of a piezoelectric transducer plate 26 clamped to the chamber plate 21 in the region between the chambers, which provides similar transducer arrangements for all of the chambers in the array. Each transducer arrangement has two spaced arrays 27 of interdigitated electrodes 12 and 13 disposed at opposite sides of the upper surface of the transducer plate 26 and a central array 28 of interdigitated electrodes 12 and 13 on the lower surface of the transducer plate 26. Two continuous electrodes 29 are disposed on the lower surface of the transducer 26 opposite the arrays 27 and a continuous electrode 30 is disposed on the upper surface opposite the array 28. Preferably, the array of interdigitated electrodes 28 has approximately twice as many electrodes as each of the arrays 27 and in each of the arrays the electrodes have the same size and spacing so that the combined curvatures produced in the side portions of the transducer by energization of the arrays 27 and 29 is approximately equivalent to the curvature produced in the central portion by energization of the array 28.

Figure 4:
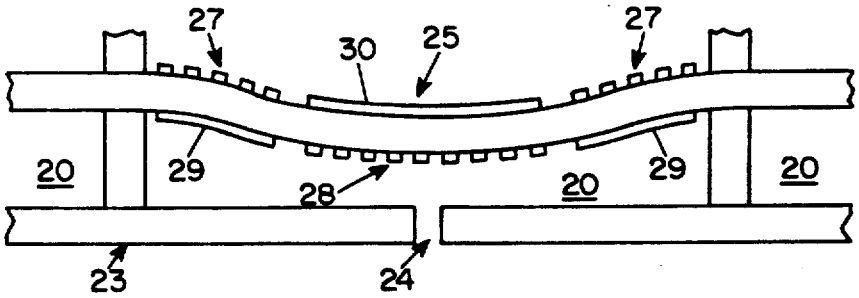
FIG. 4 is a schematic view illustrating the portion of the ink jet system shown in FIG. 3 illustrating the transducer in the energized condition.

FIG. 4 illustrates one of the ink jet chambers 20 of FIG. 3 with the transducer arrangement 25 energized to bend toward the orifice 24 so as to eject an ink drop through the orifice. Preferably, the electrodes 13, 29 and 30 are maintained at ground potential and the electrodes 12 receive a voltage pulse to produce transducer deflection causing ejection of a drop of ink from the chamber. It will be understood that the reverse effect, i.e., deflection upwardly to expand the volume of the chamber 20 upon application of a potential difference, can be obtained if the electrode configuration on the transducer surfaces is reversed. Moreover, the arrangement illustrated in FIG. 4 may be used in the fire-before-fill mode by applying a potential pulse when a drop is to be ejected, or in a fill-before-fire mode by maintaining the potential difference to normally hold the transducer in the condition shown in FIG. 4 and applying a zero potential pulse to enlarge and then contract the chamber 20.

In a typical arrangement designed to produce drops having a volume of 100 picoliters in response to 100-volt pulses applied to the electrodes 13, the transducer plate 26 has a $D_{33}$ coefficient of about $400\times10^{-3}$ meters/volt and has a thickness of about 4 microns and the chamber 20 has a width of about 160 microns and a length of about 3,000 microns and each of the arrays 27 has three positive electrodes and two grounded interdigitated electrodes while the array 28 has five positive and four grounded interdigitated electrodes. In each array, the electrodes are about 2.2 microns wide and are spaced by about 5.5 microns. With that arrangement, an applied positive voltage pulse of 100 volts produces a maximum excursion at the center of the piezoelectric transducer 25 of about 2.25 microns and the cross-sectional area of the chamber swept by the motion of the transducer is about 160 square microns, while the chamber volume displaced by the motion of the transducer is about 500 picoliters.

Consequently, a chamber only about 160 microns wide and 3,000 microns long is capable of producing a 100-picoliter drop in response to a 100-volt pulse. Moreover, the spacing between adjacent ink jet orifices in an array of ink jet chambers arranged according to the invention can be as small as about 240 microns. This is in contrast to the much larger dimensions required for extension-mode and shear-mode transducer arrangements of the conventional type.

Typically, an extension-mode transducer has a thickness of about 500 microns and produces a maximum excursion of about 0.75 microns in response to a 100-volt pulse. To produce a 100-picoliter drop in response to a 100-volt pulse, a chamber having a width of about 1,100 microns and length of about 20,000 microns is required. Because of the large chamber size requirements, the minimum spacing between adjacent jets for an aligned row of ink jet chambers is about 1,450 microns.

In an ink jet system using a conventional shear-mode transducer having a thickness of about 250 microns and a maximum excursion of about 0.04 microns in response to a 100-volt pulse, ejection of a 100-picoliter drop requires a chamber with a width of about 900 microns and a length of about 10,000 microns. In this case, the minimum spacing between adjacent orifices in an array of ink jet chambers is about 1,350 microns.

Thus, an ink jet system arranged in accordance with the present invention can provide an aligned array of ink jet orifices having a spacing between one-fifth and one-sixth of the minimum spacing for conventional ink jet systems and an ink jet chamber volume of about one-twentieth to one-fortieth the volume of conventional ink jet systems. This allows the ink jet head to be much smaller than conventional ink jet heads and to produce closer line-spacing in the image for lines produced from adjacent orifices in the array.

Figure 5:
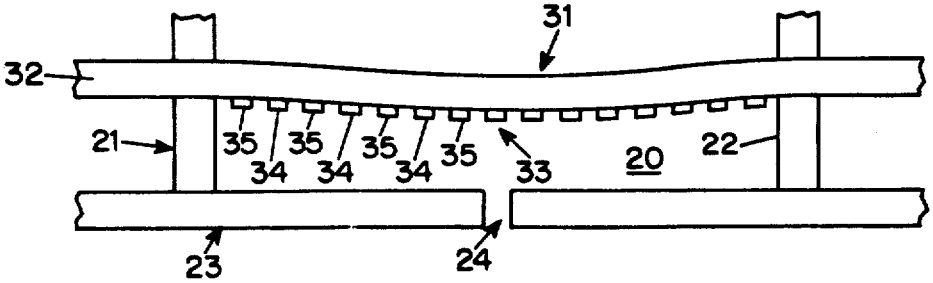
FIG. 5 is a schematic view similar to FIG. 4 showing a further embodiment of the invention.

In an alternative embodiment shown in FIG. 5, an ink jet chamber 20 of the same general type shown in FIGS. 3 and 4 is provided with a piezoelectric transducer 31 which is a portion of a thin-film piezoelectric element 32 prepared as described, for example, in the above-mentioned copending application Ser. No. 07/615,893, filed Mar. 20, 1990. The transducer 31 includes an array 33 of interdigitated electrodes 34 and 35 on one surface of the piezoelectric element, but does not include any electrode on the opposite surface. Consequently, when a potential difference is applied to the two sets of interdigitated electrodes 34 and 35, the side of the piezoelectric element adjacent to the electrode array 33 will expand, but there will be no corresponding contraction of the opposite side of the piezoelectric element. As a result, the transducer 31, being clamped at the sides of the chamber 20, will buckle in the direction toward the electrode array 33, as illustrated in FIG. 5, and the extent of the buckling depends on the thickness of the piezoelectric element, the width of the chamber 20, and the applied voltage.

For a chamber having a width of 100 microns, for example, and a piezoelectric element having a thickness of 5 microns and for a piezoelectric material having a $D_{33}$ value of $375\times10^{-12}$ meters/volt, the center of the surface containing the electrodes will be displaced about 4 microns for a 100-volt potential difference applied to the interdigitated electrodes. Larger displacements may be obtained for the same potential difference between the electrodes by using a thinner piezoelectric film, but films thinner than about 4–5 microns may be too compliant to generate the pressure required for drop ejection. This may be overcome by using transducers consisting of multiple layers of piezoelectric thin-film elements, each having its own electrode array of the type shown in FIG. 4.

With interdigitated transducer electrodes as described herein, the transducer deflection is in the same direction regardless of the direction of the applied field. This permits successive pulses of opposite polarity to be applied to the electrodes during operation of the system and the potential of each pulse can be high enough to polarize the piezoelectric material. Consequently, with alternate oppositely-directed pulses, each pulse polarizes the piezoelectric material in the direction required for maximum response to the succeeding pulse which is of opposite polarity. By driving a piezoelectric transducer with alternate oppositely-directed pulses in this manner, the transducer displacement for a given applied voltage may be increased.

Although the invention has been described herein with reference to specific embodiments, many modifications and variations therein will readily occur to those skilled in the art. Accordingly, all such variations and modifications are included within the intended scope of the invention.

We claim:

1. A transducer for an ink jet system comprising a sheet-like piezoelectric element having a movable region disposed adjacent to an ink jet chamber, an array of at least three spaced electrodes disposed on one surface of the movable region of the piezoelectric element, and means for applying one potential to alternate electrodes in the array and a different potential to other electrodes in the array to produce deflection of the movable region of the piezoelectric element.

2. A transducer according to claim 1 including means for applying ground potential to the alternate electrodes and means for applying a different potential to the other electrodes in the spaced array to cause deflection of the piezoelectric element.

3. A transducer according to claim 1 wherein the thickness of the movable region of the piezoelectric element is less than about 100 microns.

4. A transducer according to claim 3 wherein the thickness of the piezoelectric element is in a range from about 1 to about 25 microns.

5. A transducer according to claim 4 wherein the thickness of the piezoelectric element is in a range from about 3 to about 5 microns.

6. A transducer according to claim 1 including means for applying successive voltage pulses of opposite sign to alternate electrodes in the array.

7. A transducer according to claim 1 including electrode means disposed on an opposite surface of the movable region of piezoelectric element.

8. A transducer according to claim 7 including means for applying a potential to the electrode means which is the same as one of the potentials applied to electrodes in the array.

9. A transducer according to claim 7 including means for applying a potential to the electrode means which is intermediate between the two potentials applied to the electrodes in the array.

10. A transducer according to claim 7 comprising two further arrays of spaced electrodes disposed on the opposite surface of the piezoelectric element and on opposite sides of the electrode means thereon, and two further electrode means disposed at corresponding locations on said one surface of the piezoelectric element.

11. An ink jet system comprising ink jet chamber means having walls forming an ink jet chamber and an aperture through which ink may be ejected and transducer means forming a wall of the ink jet chamber, the transducer means comprising a sheet-like piezoelectric element having a movable region disposed adjacent to an ink jet chamber and an array of at least three spaced electrodes on one surface of the movable region, and means for applying one potential to alternate electrodes in the spaced array and a different potential to other electrodes in the spaced array.

12. An ink jet system according to claim 11 including electrode means disposed on an opposite surface of movable of the piezoelectric element.

13. A transducer according to claim 12 including means for applying a potential to the electrode means which is the same as one of the potentials applied to electrodes in the array.

14. A transducer according to claim 12 including means for applying a potential to the electrode means which is intermediate between the two potentials applied to the electrodes in the array.

15. An ink jet system according to claim 12 wherein the transducer means includes two further arrays of electrodes disposed in spaced relation on the opposite surface of the piezoelectric element and on opposite sides of the electrode means and two further electrode means disposed at corresponding locations on said one surface of the piezoelectric element.

16. An ink jet system according to claim 12 including a plurality of further ink jet chambers disposed in aligned relation with said ink jet chamber to provide an aligned row of ink jet apertures, wherein the sheet-like piezoelectric element is common to all of the ink jet chambers.

17. An ink jet system according to claim 12 wherein the piezoelectric element has a thickness of less than about 100 microns.

18. An ink jet system according to claim 12 wherein the piezoelectric element has a thickness in a range from about 1 microns to about 25 microns.

19. An ink jet system according to claim 12 wherein the piezoelectric element has a thickness in a range from about 3 microns to about 5 microns.

20. An ink jet system according to claim 12 wherein the means for applying potentials applies successive voltage pulses of opposite sign between the alternate electrodes and the other electrodes.

* * * * *

UNITED STATES PATENT AND TRADEMARK OFFICE

CERTIFICATE OF CORRECTION

PATENT NO. : 5,202,703
DATED : April 13, 1993
INVENTOR(S) : Paul A. Hoisington, et. al.

It is certified that error appears in the above-indentified patent and that said Letters Patent is hereby corrected as shown below:

Column 6, line 50, the word "of" should read --of the--.

Column 7, line 10, the word "movable" should read --the movable region--.

Signed and Sealed this

Twenty-sixth Day of April, 1994

*Attest:*

Bruce Lehman

BRUCE LEHMAN

*Attesting Officer*

*Commissioner of Patents and Trademarks*